US010094077B1

(12) United States Patent
Santoiemma

(10) Patent No.: US 10,094,077 B1
(45) Date of Patent: Oct. 9, 2018

(54) TENNIS COURT PLAYING SURFACE REMOVAL DEVICE

(71) Applicant: Joseph Santoiemma, Smithtown, NY (US)

(72) Inventor: Joseph Santoiemma, Smithtown, NY (US)

( * ) Notice: Subject to any disclaimer, the term of this patent is extended or adjusted under 35 U.S.C. 154(b) by 269 days.

(21) Appl. No.: 14/991,033

(22) Filed: Jan. 8, 2016

(51) Int. Cl.

| | |
|---|---|
| ***B23B 43/00*** | (2006.01) |
| ***E01C 23/082*** | (2006.01) |
| ***E01C 13/00*** | (2006.01) |
| ***E01C 23/12*** | (2006.01) |
| ***E04G 23/00*** | (2006.01) |

(52) U.S. Cl.
CPC ..... *E01C 23/082* (2013.01); *E01C 13/00* (2013.01); *E01C 23/12* (2013.01); *E01C 23/121* (2013.01); *E04G 23/006* (2013.01)

(58) Field of Classification Search
CPC ..... E04G 23/006
See application file for complete search history.

(56) References Cited

U.S. PATENT DOCUMENTS 4,789,265 A 12/1988 Wilson
5,302,051 A 4/1994 Wilson
6,273,513 B1 * 8/2001 Pope ..... E04G 23/006 15/93.1
6,299,257 B1 * 10/2001 Constantino ..... E04G 23/006 15/93.1
6,343,981 B1 * 2/2002 Buchanan ..... E04G 23/006 156/763
6,428,108 B1 * 8/2002 Chase ..... E02F 3/3414 15/93.1
6,666,522 B2 * 12/2003 Bloom ..... E04G 23/006 15/93.1
2006/0269359 A1 11/2006 Due
2010/0158608 A1 6/2010 Wilson

FOREIGN PATENT DOCUMENTS

DE 19632456 11/1997
DE 102011120344 6/2013

* cited by examiner

*Primary Examiner* — John J Kreck
(74) *Attorney, Agent, or Firm* — Thomas A. O'Rourke; Bordner & O'Rourke LLP

(57) ABSTRACT

A machine-mountable device facilitates removal of the cushioning acrylic and rubber layers overlying the concrete/asphalt base of tennis courts. The device includes: an attachment bracket, a support beam, a support plate, a scraper, and a stopper bar. The attachment bracket is configured to mount the device to any of one of several different transport machines (e.g., a loader, or forklift). The support beam is fixedly secured to the attachment bracket, and the support plate is secured to the support beam. The elongated scraper has a length between 12 and 20 inches, but is preferably between 14 and 15 inches, and optimally is about 16 inches long. The 16 inch scraper is releasably mounted to the support plate, and centered between the ends of the attachment bracket. The scraper removes the layers above the base, while the stopper bar causes the removed layers to simultaneously/automatically roll up like a carpet.

14 Claims, 10 Drawing Sheets

(Multi-Layered Tennis Court Surface)

TENNIS COURT PLAYING SURFACE REMOVAL DEVICE

FIELD OF THE INVENTION

The present invention relates to the resurfacing of cushioned recreational surfaces, particularly tennis courts, and/or track and field surfaces, and/or basketball courts, and more particularly relates to a device that is configured for efficient removal of a cushioned recreational surface.

BACKGROUND OF THE INVENTION

Many different materials have been used for recreational surfaces in the past, and such use often depends upon the sport for which it is used. The game of basketball was only invented around 1891 in Massachusetts by a physical education instructor. James Naismith, and used peach baskets mounted to walls of a gym. Today basketball is still largely played indoors on wood floors, but is also played outdoors primarily on asphalt courts. The game of tennis has a more storied history. Early versions of tennis are attributed to monks playing a hand ball game in the $11^{th}$ or $12^{th}$ century in France, known as jeu de paume ("game of the palm"), which was played over a rope strung across a courtyard. By the 1500s an early version of a wooden racquet was used, and the game evolved into what was known as Real Tennis during the 1600s, which was played indoors using a net, and which permitted play off of the waits. By the 1850s, the vulcanization of rubber led to the use of rubber tennis balls on an outdoor court, instead of the leather-covered balls previously used indoors. In 1874, Walter Clopton Wingfield received U.S. Pat. No. 157,259 for "a new and Improved Portable Court for Playing the Ancient Game of Tennis," which resembles the shape of the court used today. However, the shape of the court was modified slightly for Lawn Tennis after Winfield received his patent, and the sport was adopted by Wimbledon's All England Croquet Club in 1880.

Grass was the playing surface of choice for a long period of time. In fact, up until the 1970s, three out of the four Grand Slam Tennis tournaments were played on grass, including Wimbledon, the Australian Open, and the U.S. Open. The use of Clay (crushed shale, stone, or brick) for tennis courts was predominantly found in Spain and Italy, and remains the surface used in Roland Garros Stadium for the French Open.

Acrylic tennis court surfaces were not used for tennis tournaments until the 1940s, but are widely used today, and such cushioned acrylic courts are now used at both the U.S. Open and the Australian Open. These cushioned surfaces are also now commonly used for track and field surfaces, and some outdoor basketball courts.

Today's acrylic/rubber sports surfaces are formed with a concrete or asphalt base that is covered with one or more layers to seal the base, and to provide some cushioning. Those recreational surfaces must be resurfaced periodically—commonly every four to eight years depending on usage and maintenance factors. If the court has not been carefully maintained, moss, mold, and fungus may have infiltrated the structure, which may require additional attention (equipment and chemicals for removal). Any cracks that have formed in the concrete or asphalt base would require patching. Also, courts with an asphalt base tend to develop low spots known as birdbaths, which also tend to require patching.

However, these playing surfaces that are used at stadiums that host premier sporting events, such as the U.S. Open Tennis Championship, are desirably resurfaced every year, with additional of layers of material placed upon the existing top surface. Periodically, removal of the accumulated multitude of layers must be accomplished with due care not to cause damage to the underlying base, but must also be completed in a timely manner. The present invention is conceived and constructed to improve the effectiveness and efficiency at which the multiple layers of material may be removed.

OBJECTS OF THE INVENTION

It is an object of the invention to provide a device that may be used to efficiently remove the multiple layers of a recreational surface, particularly a multi-layered tennis court surface.

It is another object of the invention to provide a device that may be used to efficiently remove the multiple layers of a recreational surface, without damaging its base.

It is a further object of the invention to provide a device that may be releasably received upon a plurality of different pieces of transport equipment, which equipment may be used to apply a force to the device to move the device to effect removal of the cushioned layers of a recreational surface.

It is another object of the invention to provide a device that may be constructed to effect rolling of the removed layers of a recreational surface, to create a roll of such layered material, to more easily facilitate its removal from a stadium.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A machine-mountable tennis court surface removal device may be used in the removal of a plurality of cushioning (and other) layers that overlie a base layer of concrete or asphalt. The removal device may broadly include: an attachment bracket with a first mounting plate and a second mounting plate; a support beam; a support plate; and a scraper. The attachment bracket may be configured to mount the surface removal device to any one of a plurality of different transport machines (e.g., a loader, a fork lift, etc.). The attachment bracket may be secured to a first portion of the support beam.

The support plate may be secured to a second portion of the support beam, to be centrally positioned between the first and second mounting plates of the attachment bracket. The support beam may be configured such that the support plate being mounted thereto may extend at an obtuse angle with respect to each of the first and second mounting plates. A top surface of the scraper may be in contact with and mounted to a lower surface of the support plate, and is also desirably centered between the first and second mounting plates of the attachment bracket. The scraper may have a beveled end to form a sharp edge (a tip) that may be used for removal of the plurality of upper layers of the tennis court (or other similar recreational surface) from the base layer of concrete/asphalt.

For reasons discussed hereinafter, the elongated scraper has a length being between 12 inches and 20 inches, and is preferably between 14 and 15 inches. The Applicant has determined that an optimal length for the elongated scraper is most preferably about 16 inches.

The configuration of the scraper, which may include an elongated stopper bar fixedly secured to a top surface of the scraper proximate to the beveled edge, may provide the device with the ability to remove the plurality of layers from the base, and to also simultaneously and automatically cause the removed layers to roll up like a carpet runner.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" means A alone, B alone, C alone, A and B together, A and C together, B and C together, or A, B and C together.

Furthermore, the described features, advantages, and characteristics of any particular embodiment disclosed in the following specification, may be combined in any suitable manner with any of the other embodiments disclosed herein.

Figure 2:
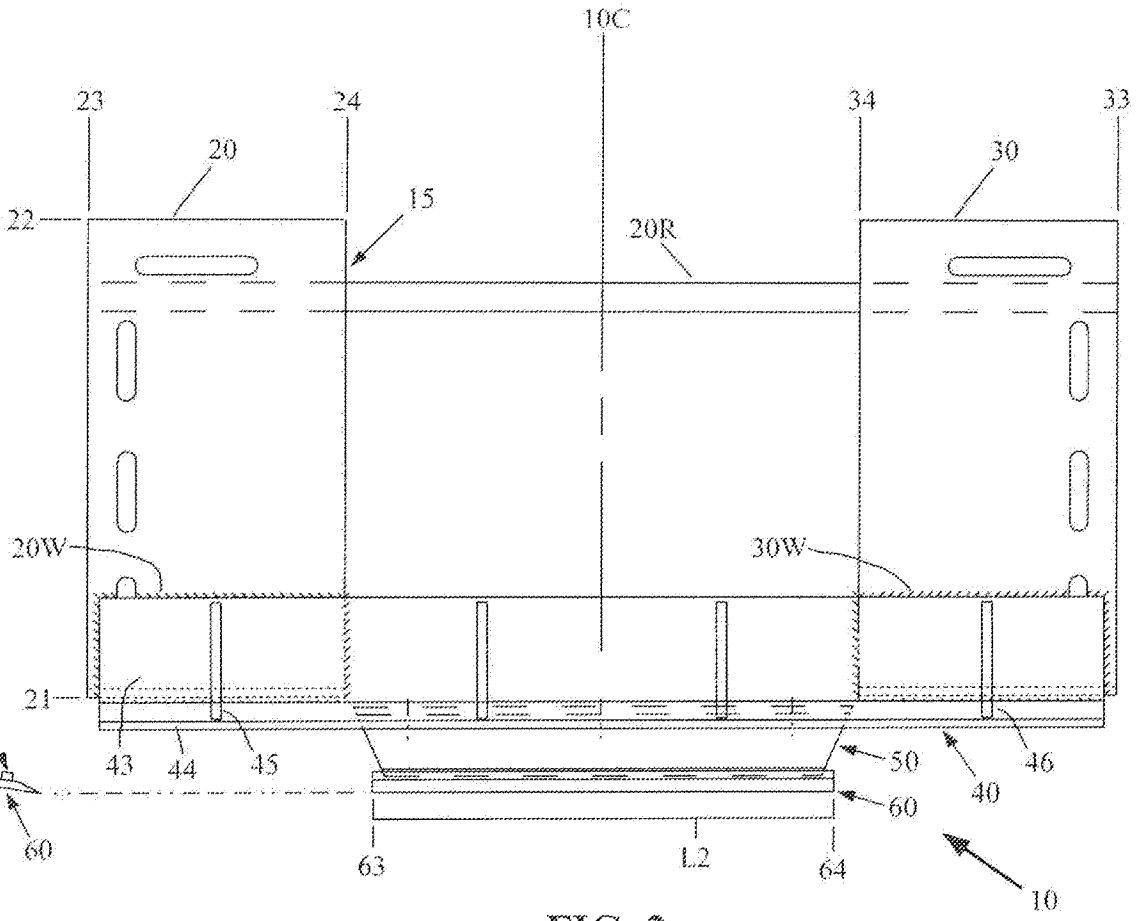
FIG. 2 illustrates a front view of a first embodiment of a tennis court surface removal device of the present invention.
Figure 3:
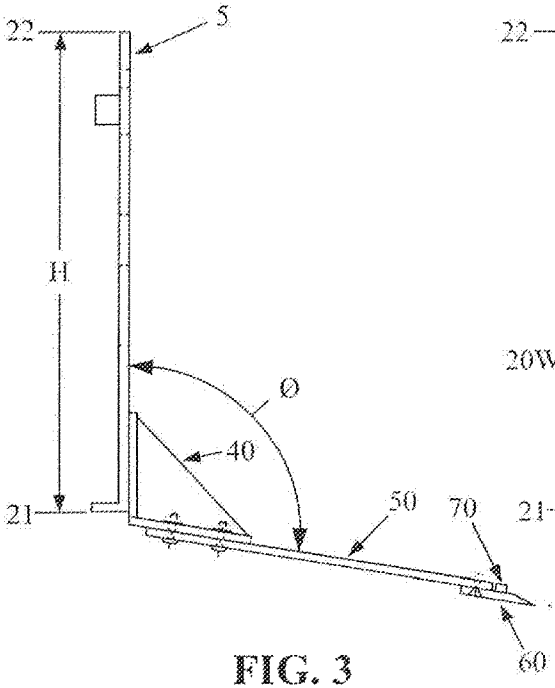
FIG. 3 is a side view of the tennis court surface removal device shown in FIG. 2.
Figure 6:
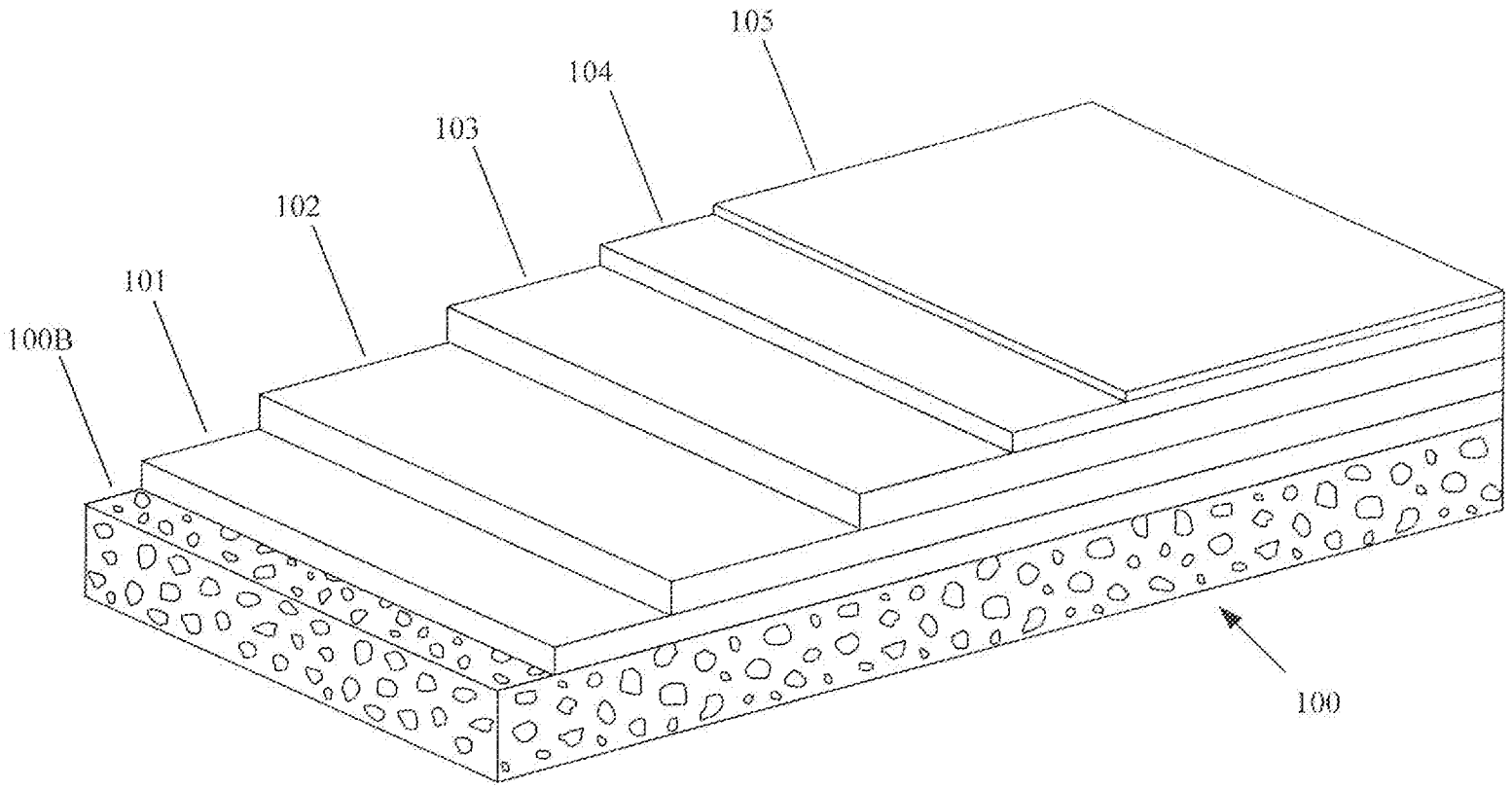
FIG. 6 is a perspective view of a base layer, and the plurality of upper layers that form a tennis court surface that the present invention is particularly configured to separate and remove from the base.

FIG. 2 and FIG. 3 respectively show a front view and a side view of a device 10 that is particularly configured to be used to efficiently remove the multiple upper layers of a cushioned recreational surface, particularly a multi-layered tennis court surface. Such a multi-layered recreational surface is depicted in FIG. 6. This multi-layered surface may be utilized not only for tennis court surfaces, but also for outdoor basketball courts, for a track and field surface, etc. Therefore, the description provided herein with respect to the material removal device being used for tennis courts is illustrative, and it is to be understood that its use may extend to any other similar cushioned recreational surface that may require such removal and resurfacing.

The device 10 shown in FIG. 2 is particularly configured to be used to remove the multiple layers of a recreational surface, without damaging its base. The exemplary tennis court surface 100 shown in FIG. 6 is typically constructed using either a concrete or an asphalt base 100B. Depending upon the layering system utilized by the particular manufacturer of the playing surface, a varied plurality of different layers is utilized above the base layer 100B. Examples of such cushioned tennis court surfaces are: DecoTurf®, which is manufactured by California Products Corp., and which was used at the Athens Olympics in 2004, the Beijing Olympics in 2008, and is currently used for the U.S. Open Tennis tournament; Novacrylic Ultracushion®, winch is manufactured by Nova Sports, U.S.A., and which was selected for use at the 2015 Davis Cup; Laykold®, which is manufactured by Advanced Polymer Technology Corp., and which is used at the Miami Open; and Action pave®, which is manufactured by Copeland Coating Co., Inc.

One such cushioned tennis court surface uses a first layer 101 directly atop the base layer 100B, where the first layer 101 is a filler course formed of an acrylic resurfacer that is blended with silica sand. Two coats of the acrylic resurfacer are preferably utilized, which may require 0.06 gallons per square yard. A second layer 102 is a heavy rubber course formed of large rubber particles, which may be of a graded size selected to provide for distinct cushioned playing characteristics. Three coats of the heavy rubber are preferably utilized, which may require 0.48 gallons per square yard. A third layer 103 is a fine rubber course formed of graded fine rubber particles that create a smooth cushioned finish, and prepares the surface for the finishing courses. Two coats of the tine rubber are preferably utilized, which may require 0.24 gallons per square yard. The fourth layer 104 is a colored texture course, which material is designed to provide a uniform surface texture. The texture chosen tor the fourth layer 104 largely determines the speed of play, and the traction provided by the tennis court. Three coats of the texture material are preferably utilized, which may require 0.12 gallons per square yard. A final color layer 105 is a finish course that is also designed to be protective in nature, to protect the underlying layers from severe weather and from degradation due to sustained exposure to ultraviolet light. Two coats of the colored protection material are preferably utilized, which may require 0.04 gallons per square yard. Acrylic latex paint may be applied atop the final layer 105 to provide lines for the particular recreational surface (i.e., lines for a basketball court, lines for a tennis court, lanes for a track, etc.).

When periodic removal of the accumulated layers is necessary, the plurality of layers is desirably separated from the base layer 100B, and all are preferably removed at the same time, while exercising care not to inflict any damage upon the base layer, which would necessitate additional repair work.

Therefore the device 10 shown in FIG. 2 is constructed to effect separation from the base layer 100B, and may also be configured to effect rolling of the separated layers of the recreational surface 100 (e.g., layers 101, 102, 103, 104, 105 . . . ), to create a roll of such layered material, to more easily facilitate its removal from a stadium or other enclosed area.

Figure 3A:
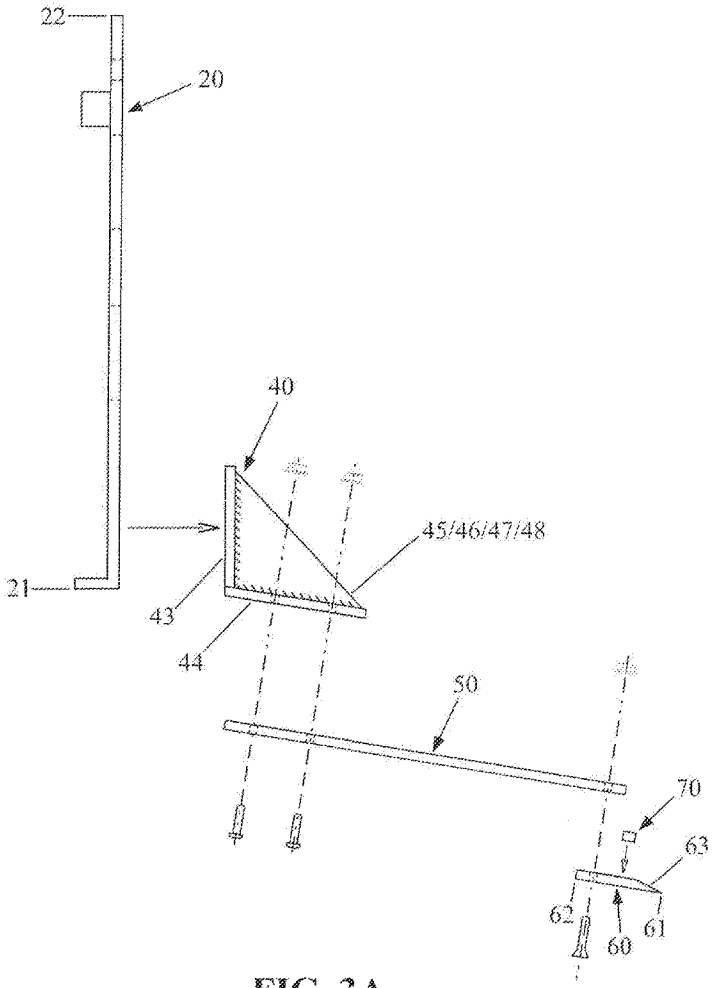
FIG. 3A is an exploded side view of the component parts of the tennis court surface removal device of FIG. 3.

As seen in FIG. 2 and the exploded view of FIG. 3A, the device 10 may be formed using an attachment bracket 15, a support beam 40, a support plate 50, a scraper 60, and a stopper bar 70.

Figure 1:
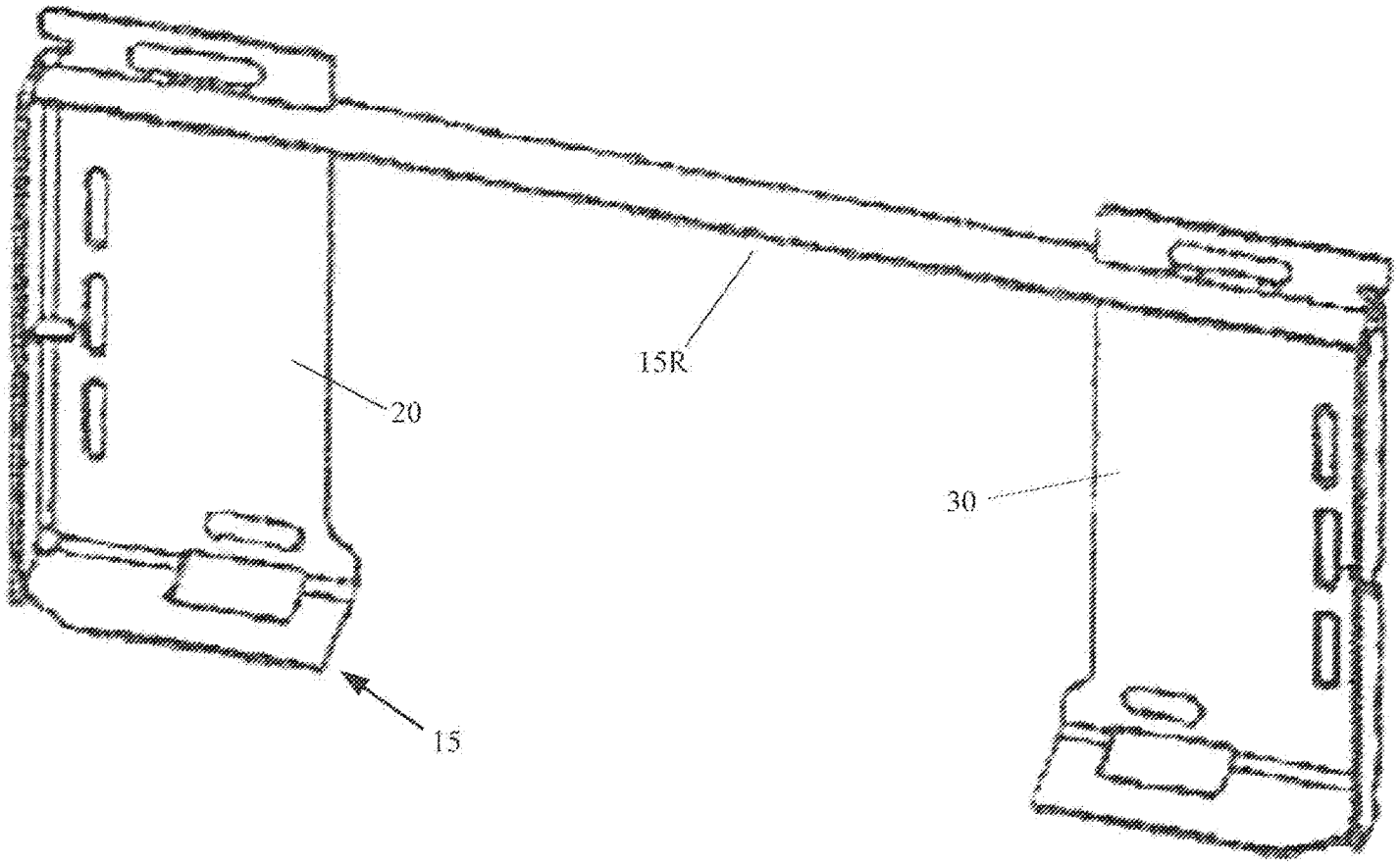
FIG. 1 illustrates an attachment bracket for a transport machine, such as a loader built by Caterpillar® or Bobcat®.

The attachment bracket may be custom designed to be received by and secured to many different suitable pieces of equipment that may be used to drive (i.e., apply a force to move) the device 10 with respect to the recreational surface, to accomplish surface removal. Merely to be exemplary, FIG. 1 illustrates an attachment bracket 15 that may be received by, and secured to, a loader built by either Caterpillar® or Bobcat®. In particular, the attachment bracket 15 may be the heavy duty model no. 1-67311112, and may thus include all the requisite mounting features, including a first mounting plate 20, a second mounting plate 30, and a cross-bar member 15R. However, the present invention is not limited to use of this or any other particular attachment/mounting bracket.

Note that the use herein of the relative terms "upper" and "lower" reflect that the device 10 is to be mounted to a piece of transport equipment with the attachment bracket 15 being initially oriented generally in vertical orientation (see e.g., FIG. 7), or a somewhat vertical orientation, as the device 10 may be mounted to a machine that may be used to tip the device at a desired angle during surface removal. Also, the use of the relative terms "outer side" and "inner side" is made according to the relative proximity of such a side with respect to the center 10C of the device, with an "inner side" being closer to the center than an "outer side."

The attachment bracket 15, including the lower end 21, may accommodate attachment of the support beam 40 thereto. The upper end 22 of attachment bracket 15 may extend sufficiently so as to be positioned at a height H above the lower end 21 and the ground that permits securing of the attachment bracket 20 to the corresponding piece of transport equipment (e.g., a machine such as a Bobcat skid steer loader). The loader (or other suitable machine) to which the device may be mounted, may be used to apply a force to the device 10 and to move the device to effect removal of the plurality of upper layers.

Figure 4:
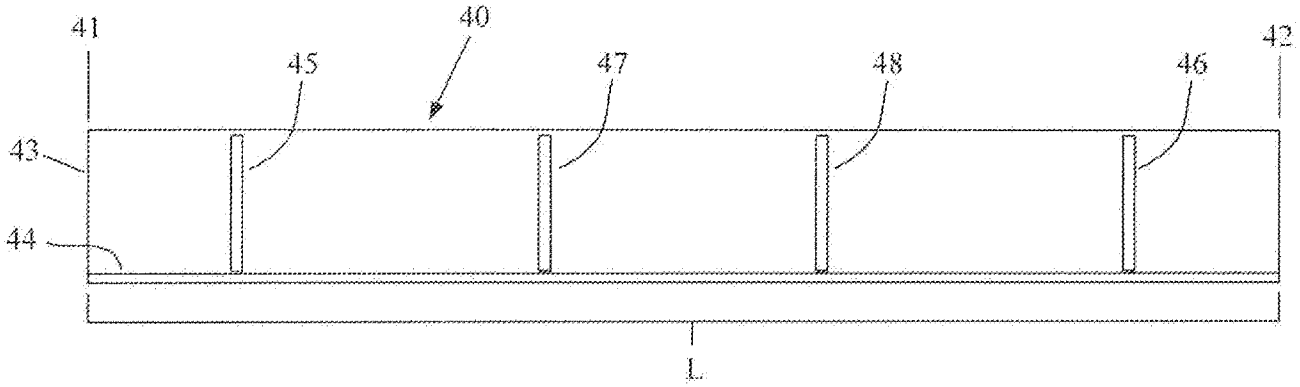
FIG. 4 is a front view of the support beam of the tennis court surface removal device shown in FIG. 2.
Figure 5:
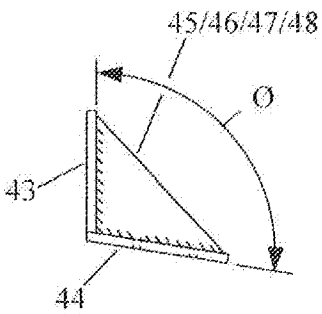
FIG. 5 is a side view of the support beam of the tennis court removal device shown in FIG. 4.

The support beam 40 may be formed as a machined part, or as a forged pan, or may also be economically formed as a welded assembly. A high strength steel may be utilized. As seen in FIG. 4, the support beam 40 may extend from a first end 41 to a second end 42. The support beam 40 may broadly include an elongated "vertical" (i.e., upright) beam plate 43, and an elongated angled beam plate 44, which may be welded together (or may be integrally formed) to form an angle, Θ, therebetween, and may also include a plurality of beam stiffening ribs. The angle Θ, as shown for support beam 40 of device 10, may be an obtuse angle, which may advantageously permit the device to be utilized on certain pieces of transport equipment (e.g., a folk lift) that may not have the capability to provide as much angularity with respect to the ground, as may be needed during surface removal operations. However, where the surface removal device is to be mounted to a transport machine such as a loader that may be capable of imparting well over 90 degrees of angularity to the device 10, the angle, Θ, may be 90 degrees, as shown for device 11 in FIG. 10.

For support beam 40, a first beam stiffening rib 45 may be welded to (or integrally formed with) both the upright beam plate 43 and the angled beam plate 44, at a position that may ultimately be substantially centered between the first (outer) side 23 and second (inner) side 24 of the first mounting plate 20, once the support beam 40 is joined to the attachment bracket 15 (see FIG. 2). A second beam stiffening rib 46 may similarly be welded to (or integrally formed with) both the upright beam plate 43 and the angled beam plate 44, at a position that may ultimately be substantially centered between the first (outer) side 33 and second (inner) side 34 of the second mounting plate 30. The support beam 40 may be welded to the attachment bracket 15. The length L of the support beam 40 may be slightly smaller than the length of the attachment bracket (i.e., less than the distance between outer ends 23 and 33), as seen in FIG. 2. This arrangement may permit welding of two ends of the support beam 40 to a side surface of the attachment bracket 15, and welding of two ends of the attachment bracket to a distal side surface of the support beam (i.e., welding about an entire periphery of the faying contact therebetween), for each of mounting plates 20 and 30. These peripheral welds 20W and 30W are illustrated using angled tick marks in FIG. 2.

Although the upright beam plate 43 of the support beam 40 may joined to each of the first mounting plate 20 and the second mounting plate 30 of the attachment bracket 15 using mechanical fasteners, it may preferably be welded thereto instead, as described above. Use of a suitable welding technique for the joining may eliminate a protruding fastener head or nut on the side of the first and second mounting plates (i.e., the left side of the mounting plates, as seen in FIG. 2), which may otherwise interfere with structure of the machine, and may also serve to eliminate the need of having to flush the fastener therein.

The support plate 50 may be secured to the angled beam plate 44 of the support beam 40, using mechanical fasteners (e.g., a bolt, lock washer, and a nut), or may instead be secured thereto using a suitable welding technique.

The scraper 60 may be releasably secured to the support plate 50 using mechanical fasteners (e.g., a bolt, a washer, and a nut), which may permit replacement of the scraper, as required. The positioning and length of the scraper 60 is crucial to achieving optimal surface removal results using the tip of its beveled surface 63 at its leading end 61. Experimentation has resulted in the finding that the use of an excessively long length L2 for the scraper 60 (i.e., the distance between lateral ends 63 and 64 shown in FIG. 2) has a tendency to cause damage to the base layer 100B.

This damage may be the result of a confluence of factors, including, but not limited to: a disparity between the flatness of the tip of the leading end 61 of the scraper 60 and the waviness (i.e., degree of flatness) of the top surface of the base layer 100B; the waviness or unevenness in the top surface of the base layer 100B upon which the wheels of the transport machine rest/travel, and to which the device 10 is mounted, which unevenness experienced by the moving wheels may affect the orientation (i.e., angularity) of the tip of the scraper, and may thus affect and exaggerate the consistency of contact at both the first lateral end 63 at the tip and the second lateral end 64 at the tip of the scraper; and any inconsistency between the left-side mounting features and the right-side mounting features of the machine to which the mounting plates 20/30 and cross bar 15R of attachment bracket 15 are to be mounted, which may again result in a disparity in contact with the top surface of the base 100B by the leading end 61 at each of the first side 63 and the second side 64, which would be exaggerated with an increasing scraper length.

The Applicant has determined that the tendency towards damaging the concrete/asphalt base 100B is minimized, and a balance is struck between seeking to quickly remove the plurality of cushioned layers over the entire tennis court in as few passes as possible, and effectively removing the layers (101, 102, 103, 104, 105 . . . ) while preserving the integrity of the base, when the length L2 of scraper 60 is at least 12 inches long hut less than 20 inches long, but is preferably between 14 and 18 inches. The Applicant has determined that an optimal length L2 for the elongated scraper is most preferably 16 inches long.

In addition, to further minimize the effect of some of the above-noted factors, the scraper 60 may optimally be positioned to be centered between the mounting plates 20/30 (i.e., centered between the outer end 23 of the first mounting plate 20 and the outer end 33 of the second mounting plate 30), which may serve to centrally position the device 10 laterally between the left-side wheels and the right-side wheels of the transport machine to which it is mounted. To suitably support the scraper 60 at this central position, the support plate 50 may itself be centrally secured to the angled beam plate 44 of the support beam 40. To provide stable support for the scraper 60, the support plate 50 may be trapezoidal in shape, as it may flare outwardly (i.e., widen) as it extends toward its attachment with the support beam 40.

Figure 7:
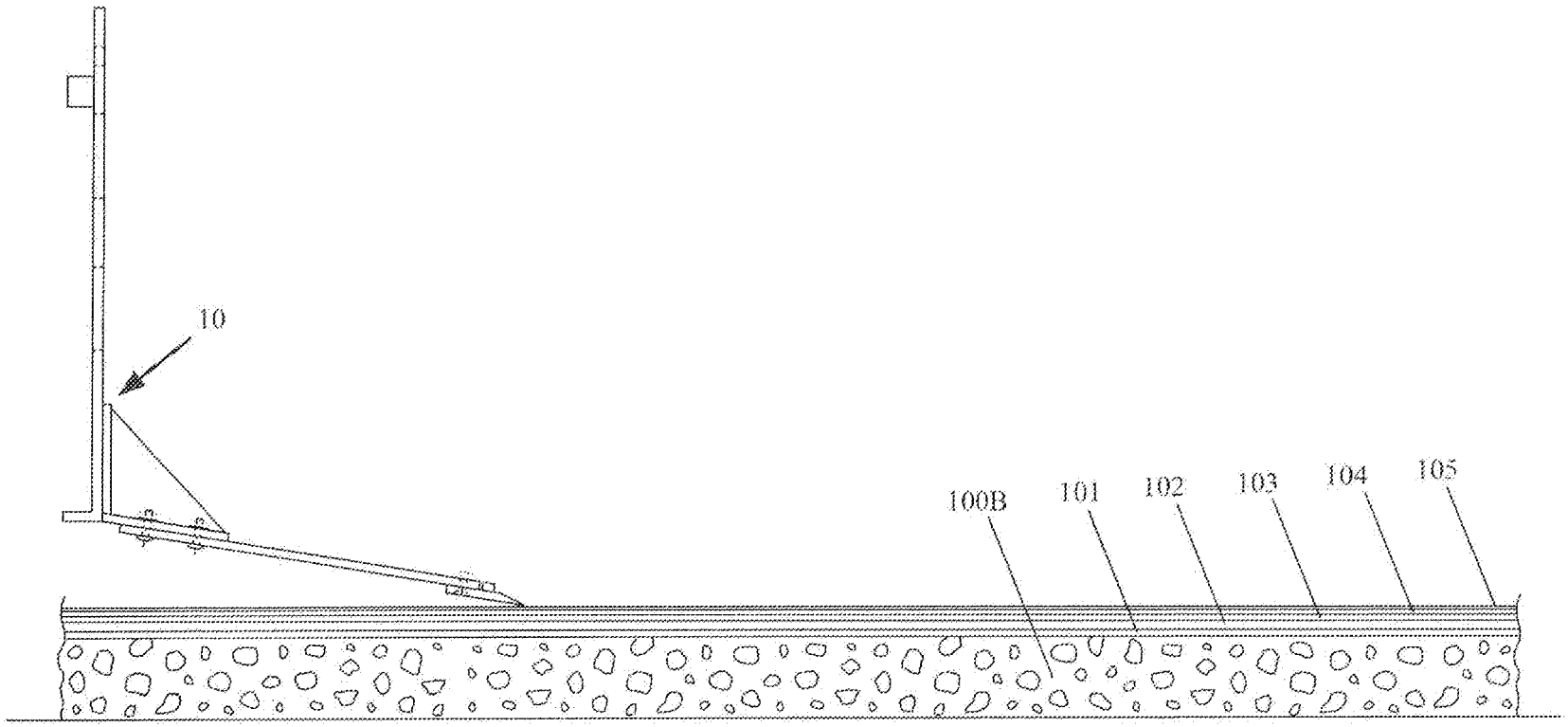
FIG. 7 is a side view of the tennis court surface of FIG. 6, but also showing a first embodiment of the removal device of the present invention resting upon and prior to being actuated to effect removal of the upper layers.
Figure 8:
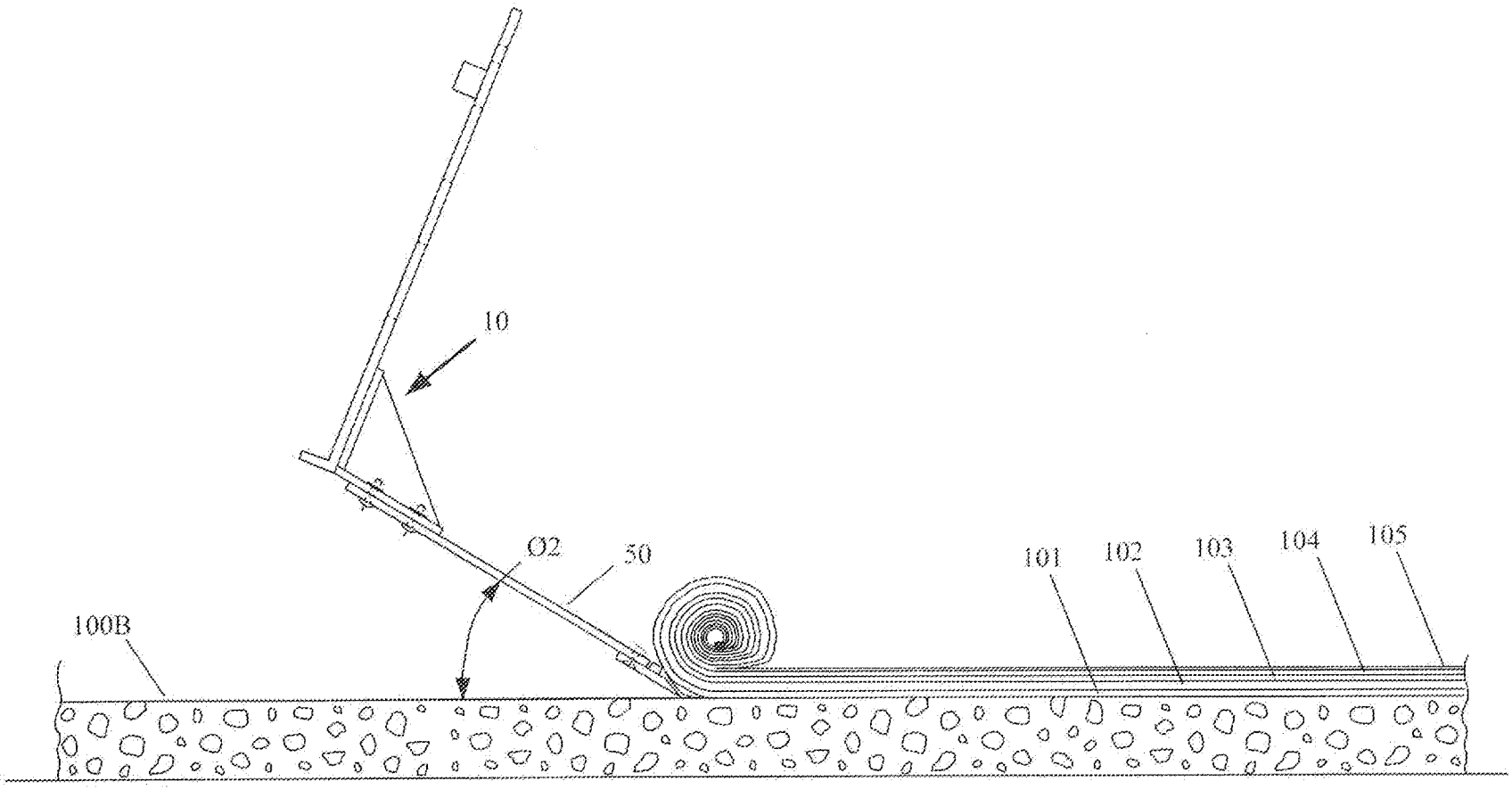
FIG. 8 is a side view of FIG. 7, but showing the removal device of the present invention at roughly a 30 degree angle, and being actuated to effect removal of the upper layers and to simultaneously and automatically cause the removed layers to roll up like a carpet.
Figure 8A:
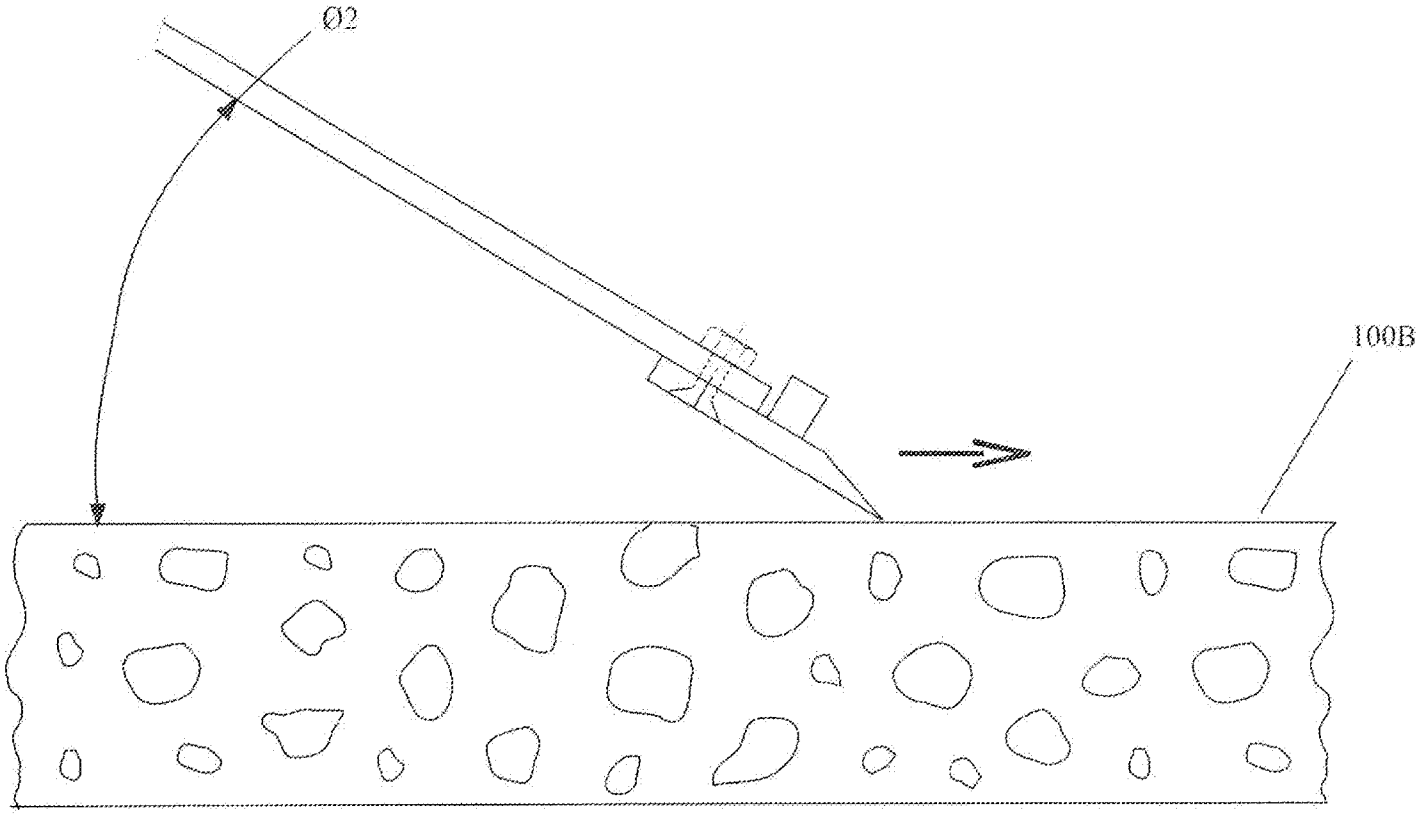
FIG. 8A is an enlarged detail view showing the tip of the blade contacting the concrete base, as seen in FIG. 8.

Initial operation of the device 10 with respect a layered and cushioned tennis court surface is shown in FIG. 7, where the tip of the beveled end 61 of the scraper 60 is merely resting upon the uppermost layer, and the device has not been angled to begin removal. FIG. 8 illustrates removal of the plurality of layers 101, 102, 103, 104, and 105 by the device 10. The angle, Θ2, at which the support plate 50 may be positioned with respect to the base 100B may be roughly 30 degrees, to being the removal (scraping) operation. The loader may drive the tip of the beveled leading end 61 of the scraper 60 downward into contact with the top of the base 100B (see, FIG. 8A, which does not show the plurality of layers), and then cause the scraper to translate across the top of the base to separate the plurality of layers therefrom. As the scraper 60 of device 10 is cause to translate by the transport machine, which is driven by a first worker, a second worker walks beside the scraper to carefully monitor that appropriate contact of the scraper 60 with the base 100, and that the successfully removal of the plurality of layers is consistently occurring.

In that respect, the degree of adhesion of the lower most layer 101 with the base 100B depends upon the particular recreational surface (i.e., the type of material used by the manufacturer and the quality of the installation). Where the adhesion therebetween may be greater, increasing scraping angles may necessarily be used, as shown by the roughly 45 degree angularity in the illustration of FIG. 9. Generally, scraping angles in the range of 30 degrees to 45 degrees are utilized.

Due to the friction from the resulting contact between the tip of the beveled end 61 of the scraper 60, and the top surface of the concrete/asphalt base 100B, the tip will become too dull for effective surface removal after roughly every 15 minutes of constant usage. After each of these intervals, the device 10 must be elevated, and a fresh grind will be put onto the tip of the beveled end 61 of the scraper 60 using a hand grinder. Eventually, such frequent grinding of the beveled end 61 of the scraper 60 may necessitate that a new scraper be utilized, which may be facilitated, as noted hereinabove, through the use of mechanical fasteners for the joining of the scraper 60 to the support plate 50.

Figure 9:
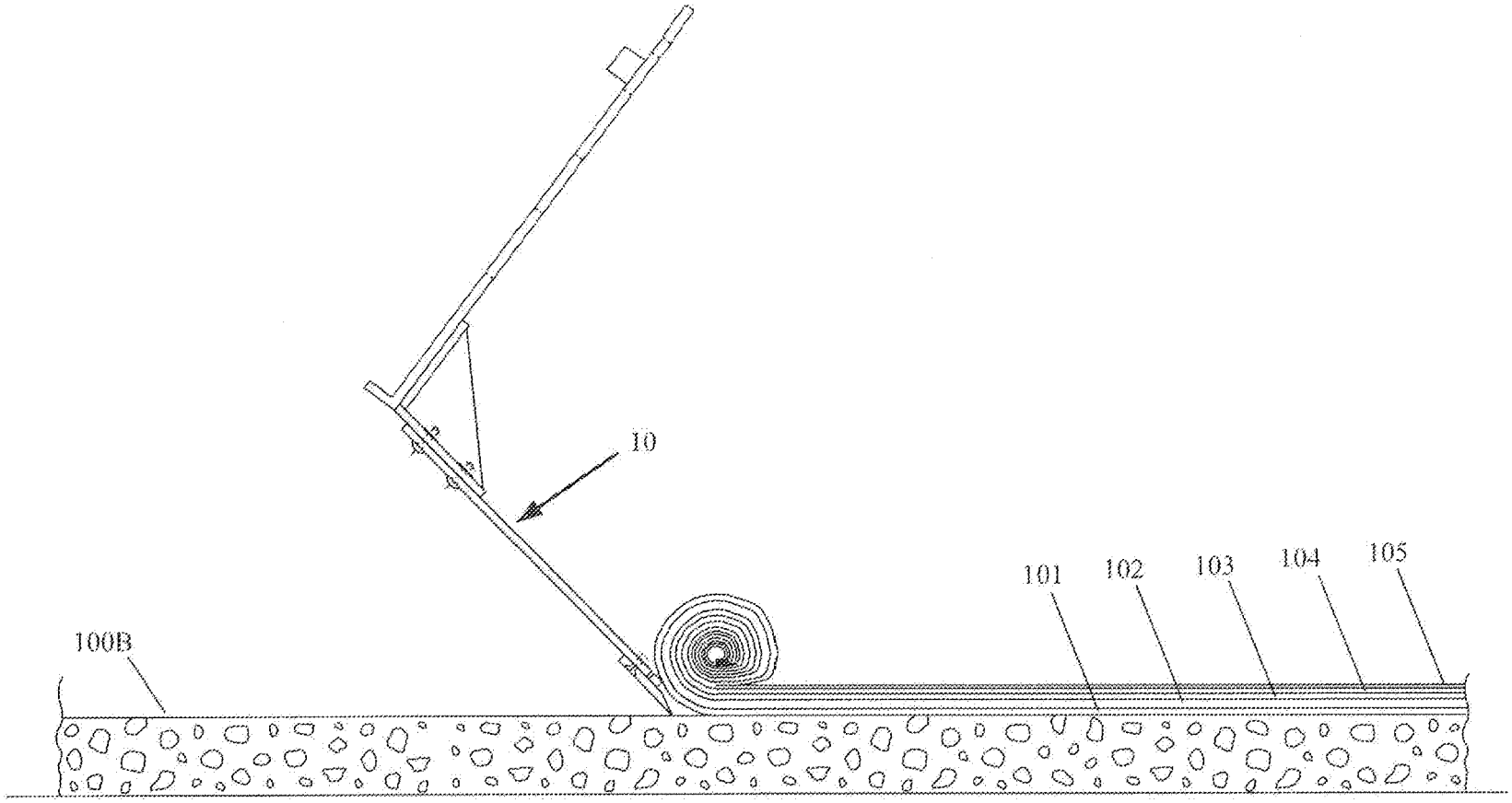
FIG. 9 is the side view of FIG. 8, but showing the removal device oriented at roughly a 45 degree angle.

Another feature provided by the surface removal device 10 is the ability to remove the plurality of layers (101, 102, 103, 104, 105 . . . ) from the base 100B, while simultaneously and automatically causing the removed layers to roll up like a carpet runner, as illustrated in FIG. 8 and FIG. 9. To accomplish this, a top surface of the scraper 60 may be in contact with and mounted to a lower surface of said support plate 50, to be secured thereto (note that a flush head fastener may be used on the lower side of the scraper 60), and in addition, a stopper bar 70 may be welded to the top surface of said scraper, proximate to the beveled leading end 61 (FIG. 3). The stopper bar 70 may also serve to protect the integrity of the heads of fasteners that attach the scraper 60 to the support plate 50, which may otherwise become compromised by the continued sliding contact therewith of the removed layers (101, 102, 103, 104, 105 . . . ). Thus, the top of the stopper bar 70 may protrude above the tops of the fasteners (see e.g., the arrangement of FIG. 10).

Figure 10:
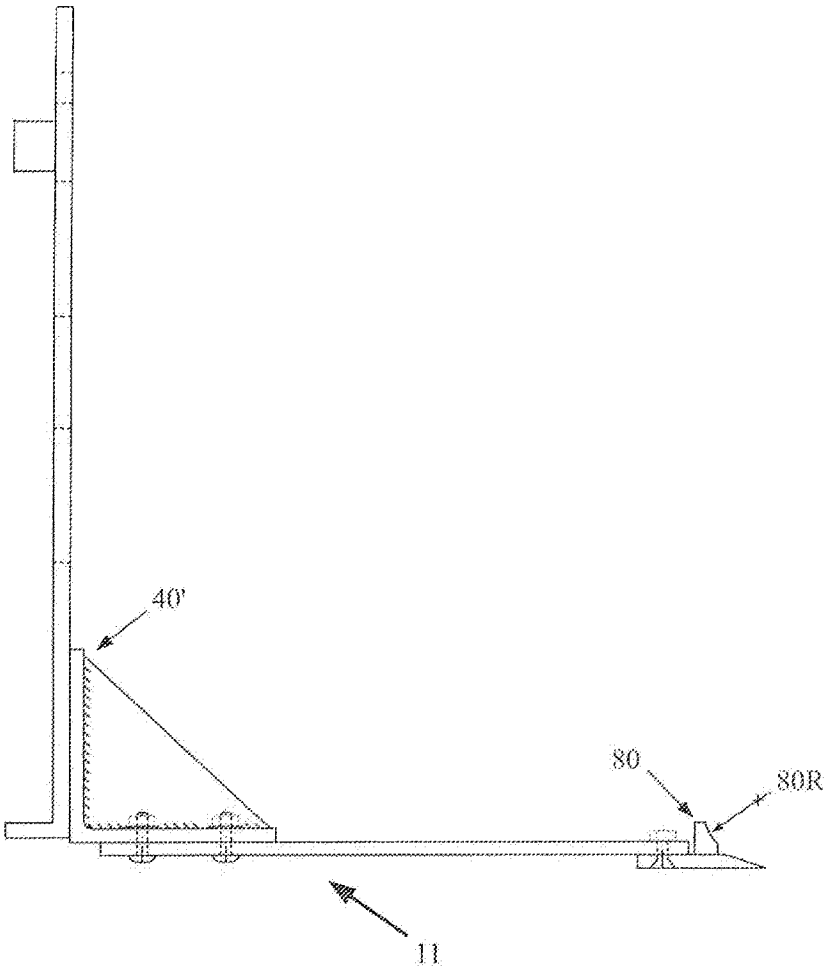
FIG. 10 is a side view of an alternate embodiment of the tennis court surface removal device of the present invention.

To better facilitate deflecting of the removed layers away from the fastener heads and to better roll up the removed layers like a carpet, a stopper bar 80, as shown in FIG. 10. may have a radiused surface 80R. The radiused surface 80R may be formed such that the beveled surface of the scraper 60 may be tangent to the radius.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A machine-mountable tennis court surface removal device, for use in removing a plurality of layers that overlie a base layer of concrete or asphalt, said removal device comprising:

an attachment bracket configured to mount said surface removal device to a transport machine; said attachment bracket having a length between a first end and a second end of said attachment bracket;

a support beam, said support beam comprising a length between a first end and a second end of said support beam; said attachment bracket fixedly secured to a first portion of said support beam;

a support plate, said support plate secured to a second portion of said support beam, to be centrally positioned between said first and second ends of said attachment bracket;

a scraper mounted to said support plate, said scraper comprising a first end distal from said mounting with said support plate, said first end of said scraper comprising a bevel configured to form a sharp edge; wherein said scraper mounted to said support plate comprises a top surface of said scraper in contact with a lower surface of said support plate, to be secured thereto; and a stopper bar welded to said top surface of said scraper, proximate to said beveled edge; wherein said stopper bar comprises a radiused surface configured to deflect and to cause the plurality of removed layers to roll up.

2. The machine-mountable tennis court surface removal device according to claim 1 wherein said elongated scraper comprises a length being between 12 inches and 20 inches.

3. The machine-mountable tennis court surface removal device according to claim 2 wherein said length of said elongated scraper is preferably between 14 and 18 inches.

4. The machine-mountable tennis court surface removal device according to claim 3 wherein said length of said elongated scraper is most preferably 16 inches.

5. The machine-mountable tennis court surface removal device according to claim 4 wherein said support beam comprises:

an elongated first plate and an elongated second plate, said first plate being welded to said second plate at an elongated side of each said plate, to form an angle therebetween; and a plurality of stiffening ribs, with each said stiffening rib being welded to each of said first and second plates.

6. The machine-mountable tennis court surface removal device according to claim 5, wherein said length of said support beam is less that said length of said attachment bracket; and wherein said support beam is fixedly secured to said attachment bracket with a weld about an entire periphery of faying contact therebetween.

7. The machine-mountable tennis court surface removal device according to claim 6, wherein said 16 inch long scraper is centered between said first end and said second end of said attachment bracket.

8. A machine-mountable tennis court surface removal device, for use in removing a plurality of layers that overlie a base layer, said removal device comprising:

an attachment bracket configured to mount said surface removal device to a transport machine; said attachment bracket having a length between a first end and a second end of said attachment bracket;

a support beam, said support beam comprising a length between a first end and a second end of said support beam; said attachment bracket fixedly secured to a first portion of said support beam;

a support plate, said support plate secured to a second portion of said support beam, being centrally positioned between said first and second ends of said attachment bracket;

a scraper mounted to said support plate, said scraper comprising a first end distal from said mounting with said support plate, said first end of said scraper comprising a bevel configured to form a sharp edge; wherein said scraper mounted to said support plate comprises a top surface of said scraper in contact with a lower surface of said support plate, to be secured thereto; and a stopper bar fixedly secured to said top surface of said scraper, proximate to said beveled edge; wherein said stopper bar comprises a radiused surface configured to deflect and to cause the plurality of removed layers to roll up.

9. The machine-mountable tennis court surface removal device according to claim 8 wherein said support beam comprises:

an elongated first plate and an elongated second plate, said first plate being welded to said second plate at an elongated side of each said plate, to form an angle therebetween; and a plurality of stiffening ribs, with each said stiffening rib being welded to each of said first and second plates.

10. The machine-mountable tennis court surface removal device according to claim 9, wherein said length of said support beam is less that said length of said attachment bracket; and wherein said support beam is fixedly secured to said attachment bracket with a weld about an entire periphery of faying contact therebetween.

11. The machine-mountable tennis court surface removal device according to claim 10, wherein said scraper is centered between said first end and said second end of said attachment bracket.

12. The machine-mountable tennis court surface removal device according to claim 11, wherein said elongated scraper comprises a length being between 12 inches and 20 inches.

13. The machine-mountable tennis court surface removal device according to claim 12, wherein said length of said elongated scraper is preferably between 14 and 18 inches.

14. The machine-mountable tennis court surface removal device according to claim 13, wherein said length of said elongated scraper is most preferably 16 inches.

* * * * *